US005910033A

United States Patent [19]

Norrstrand

[11] Patent Number: 5,910,033

[45] Date of Patent: Jun. 8, 1999

[54] DEFLECTION MECHANISM FOR SHIP HULLS

[75] Inventor: Clas Norrstrand, Östhammar, Sweden

[73] Assignee: Marine Technology Development Ltd., Guernsey, United Kingdom

[21] Appl. No.: 08/945,854

[22] PCT Filed: May 10, 1996

[86] PCT No.: PCT/SE96/00617

§ 371 Date: Nov. 7, 1997

§ 102(e) Date: Nov. 7, 1997

[87] PCT Pub. No.: WO96/35612

PCT Pub. Date: Nov. 14, 1996

[30] Foreign Application Priority Data

May 12, 1995 [SE] Sweden ..... 9501768

[51] Int. Cl.[6] ..... B63H 11/103

[52] U.S. Cl. ..... 440/47; 440/38

[58] Field of Search ..... 440/38, 47; 114/145 R, 114/145 A

[56] References Cited

U.S. PATENT DOCUMENTS 3,942,463 3/1976 Johnson, Jr. et al. .
5,401,198 3/1995 Toyohara et al. .

FOREIGN PATENT DOCUMENTS 3005682 11/1982 Germany .
8805008 7/1988 WIPO .

*Primary Examiner*—Jesus D. Sotelo
*Attorney, Agent, or Firm*—Young & Thompson

[57] ABSTRACT

The present invention discloses a deflection member for draining, during the operation of a ship hull, an inlet channel (2) to a turned off water jet unit. The deflection member includes a flap (6) that is rotatably or shiftably attached to a bottom of a ship hull. The flap in disposed in front of or immediately in front of an inlet. When the flap is immersed, the flap creates a cavity (0) outside the inlet opening to cover the same.

12 Claims, 3 Drawing Sheets

DEFLECTION MECHANISM FOR SHIP HULLS

TECHNICAL FIELD

This invention relates to a deflection mechanism for ship hulls.

BACKGROUND INFORMATION AND SUMMARY OF THE INVENTION

This invention relates to a device for evacuating an inlet to a water jet unit that is turned off wherein the water jet unit is disposed in a ship hull having a plurality of driving mechanisms. More particularly, the invention relates to a member that is movably engaged to a bottom of a ship hull. When the ship hull is in operation, the member is immersed into the relative water flow in front of the inlet of the driving mechanism. The configuration of the member is such that the water flow is deflected so that a cavity is formed in front of the intake opening to cover the same. In this way, water is prevented from flowing in through the intake. Additionally, the inlet of the turned off driving mechanism is drained. The present invention also relates to the use of such a deflection mechanism for this purpose and a method for draining the inlet of the turned off water jet unit while the ship hull is in operation.

Fast moving ship hulls are more often equipped with multiple driving mechanisms which often include the water jet units. Thus, there are many ships today that have up to four driving units. These are designed for velocities which often exceeds 40 knots so that it is easy to realize the need for maintaining the economy of operation while cruising at a lower velocity for example, in an archipelago or during night cruises when the passengers desire a smooth cruising speed.

The driving mechanisms are generally constructed to provide a good output at a high efficiency at the cruising speed which the ship is designed for. Therefore, if the effect of the output is reduced then the economy of operation is also reduced. It is therefore often more advantageous to completely turn off one of many units and to operate the remaining units at a constant output. This cannot be done without causing certain drawbacks such as increased resistance and vibrations. Besides the resistance caused by the impellent disposed in the turned off water jet units, the water flow through the intake is also undesirable and unnecessary due to increased weight which may be substantial. These drawbacks are obviously more apparent when one of the driving mechanisms have broken down and it is desirable to operate the ship at an acceptable cruising speed.

One objective of the present invention is to remove some of the above mentioned drawbacks by providing a deflection member that is movable and continuously adjustable and disposed in front of or adjacent to a forward edge of the intake. The deflection member creates a cavity defined in-the water that is outside the intake and covers the same. Thus, the penetration of water is prevented and the channel is drained so that any resistance from an idle impellent is eliminated. Additionally, the deflection member provides reduced weight and a corresponding reduced resistance to forward movement.

The objective is satisfied by the deflection member described in the appended claims.

BRIEF DESCRIPTION OF THE DRAWINGS

The present invention is described in more detail below with reference to the figures, wherein.

DETAILED DESCRIPTION OF PREFERRED EMBODIMENTS

Figure 1A:
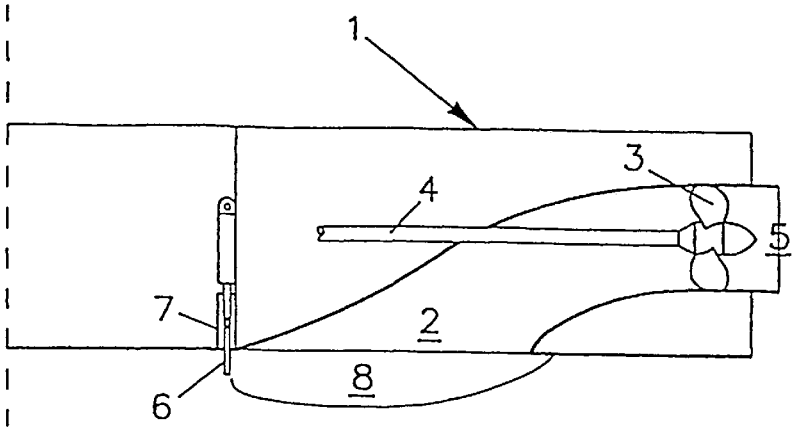
FIGS. 1*a* and 1*b* show a side view and a rear view of a first preferred embodiment of a deflection member of the present: invention.

FIG. 1*a* shows a cross section along a ship hull having an intake 2 leading to a driving mechanism of a water jet type. The impellent of the mechanism is referred to with reference numeral 3, the driving shaft with reference numeral 4 and the outlet with reference numeral 5. At the bottom of the ship hull, in front of the inlet 2, is a deflection member 6 disposed. In one preferred embodiment, this member is formed as a disc shaped flap 6. The flap is vertically shiftable by mechanical, electrical or hydraulic driving members, not described in detail. The driving members may be a conventional and known type to immerse the flap into the water flow to deflect the water against the lower edge of the flap. When the flap is in a rest position, it is received by a recess of defined in the bottom of the ship hull so that the shape of the flap is adapted to the shape of the bottom of the ship hull. The driving members are obviously controllable to adjust the depth of immersion of the deflection member or flap 6 to a desirable depth at various cruising speeds.

The flap 6 has preferably a width that exceeds the width of the inflow channel at the inlet. Flow tests have shown that the flap 6 should have a width that is up to 180% of the width of the inlet. It is to be understood by reviewing the figures that the inlet/inlet opening 2 is longish or oval in a plan view so that the length of the cavity 8 that is formed when the flap is immersed into the water flow may have varied lengths depending on the shape of the inlet opening. This length may be controlled by the immersion depth of the flap in the adjustment of to the cruising speed.

Figure 1B:
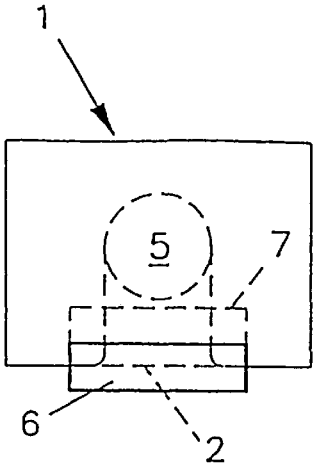
Figure 5:
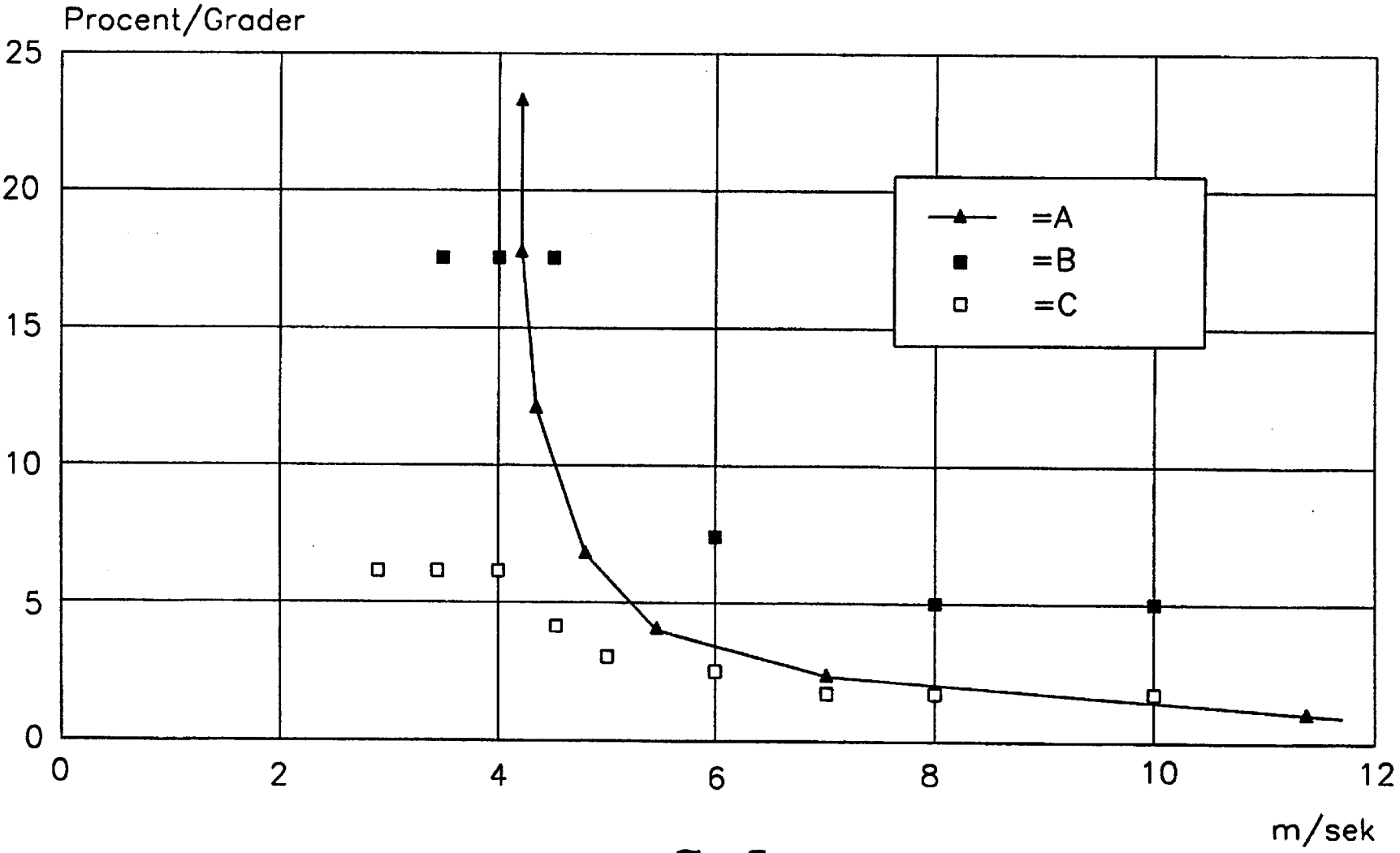
FIG. 5 is a graphical illustration showing the required depth of immersion resp. immersion angle of the three preferred embodiments according to measurements obtained in a test of a model.

With reference to FIG. 5, a diagram shows the required immersion depths in relation to the width of the flap 6 to drain the inlet 2 of a model (according to FIG. 1) in which the inlet has a width of 100 millimeter. The solid line A of the diagram shows, for example, that a speed (horizontal scale) of 7 meters/second (approximately 13.5 knots) requires that the flap is immersed into the relative water flow to a depth that corresponds to about 2.5% (see vertical scale) of the width of the flap. In the actual test of the model, this width was 180 millimeter and the immersion depth was 4.5 millimeter. At a speed of about 20 knots an immersion depth of only 1.8 millimeter is required to drain the inlet of the model. This and other test's of the model were conducted in a flow tunnel having the dimensions of 3.0×0.5×0.9 meters and the flow speed was between 4 and 11 meters/second and the adjustment angle of the ship hull was 2 degrees as measured against the horizontal plane. The flap 6 is, due to the small immersion depth when in the operational mode, only exposed to moderate hydro-dynamical forces which exert only a limited load on bearing and driving members.

The increased resistance that is created by the flap 6 when the flap is in its immersed operational position is outweighed by the eliminated resistance caused by the idle impellent and the reduced weight. Together, this reduces the overall resistance to forward movement. A desirable side effect is achieved in some situations because the increased water pressure at the bottom of the ship hulled caused by the flap 6 provides a desirable trimming of the operational position of the vessel.

Figure 4:
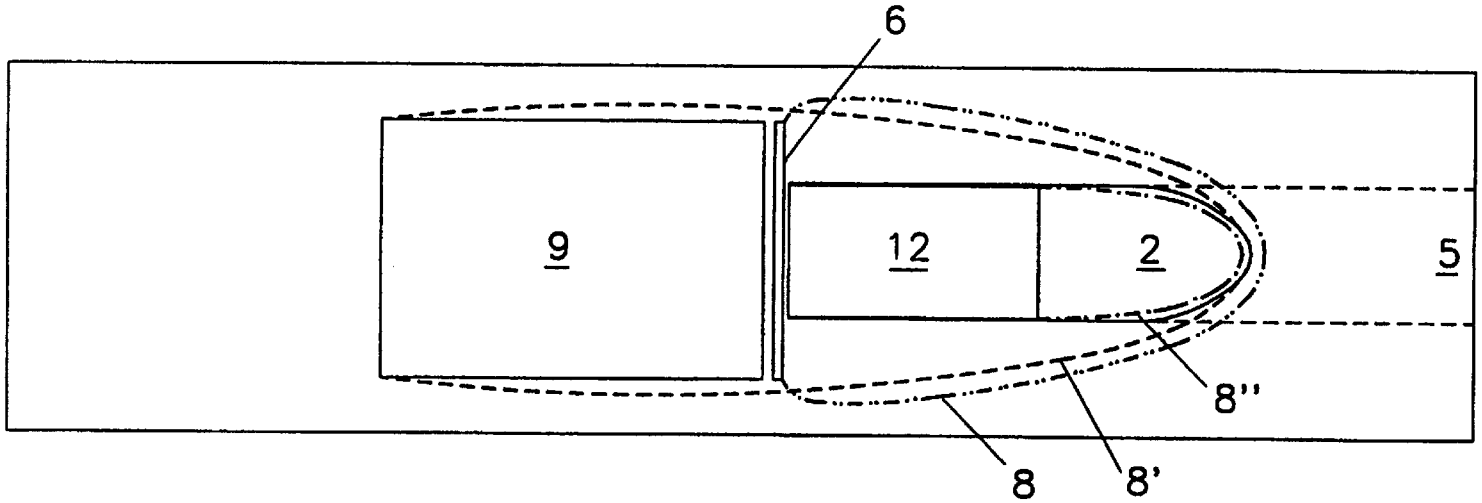
FIG. 4 shows a side view and a bottom view of the shape of the cavity formed by immersing the deflection member of the present invention into a flow of water.
Figure 4:
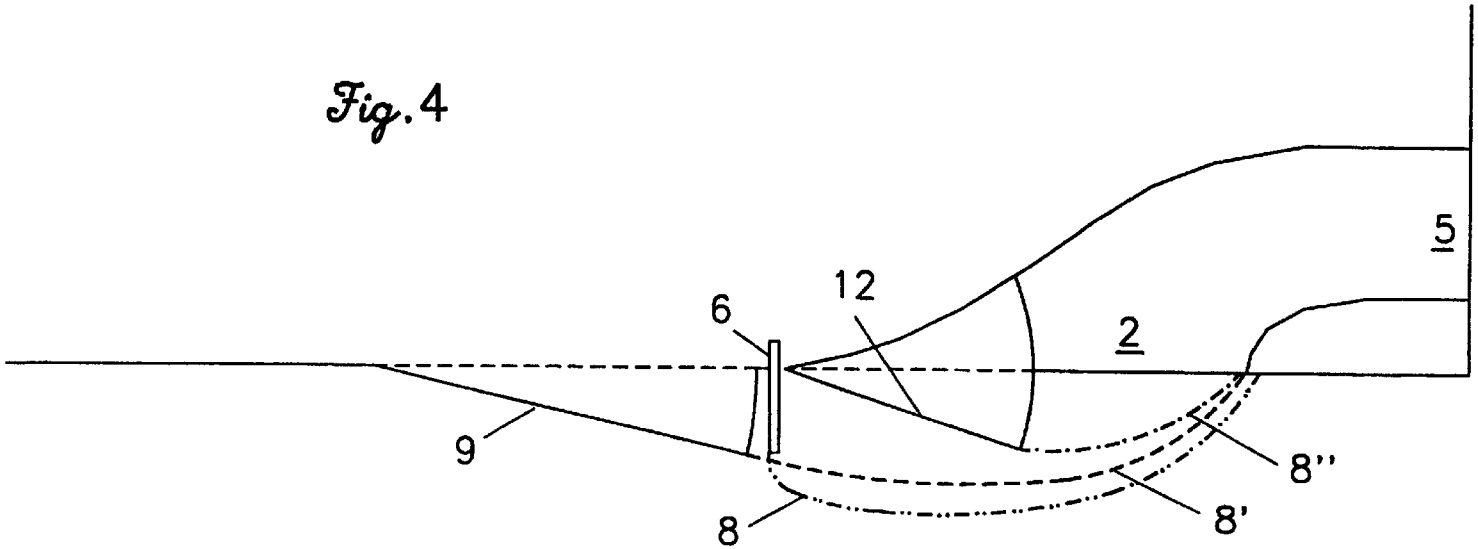

With reference to FIG. 4, the cavity 8 is shown with a broken line as viewed from below and as viewed from the side. The disc shaped flap 6 is substantially vertical or perpendicular to the bottom of the ship hull and is perpendicular to the direction of the forward movement of the ship. Surprisingly, it has been shown that the flap provides a stable cavity 8 within a wide range of velocities so that the width of the cavity is widened right behind the flap and clearly exceeds the width of the flap in this area. In this way, a sufficient length of the cavity is obtained without having to over dimension the flap or to immerse the flap to an exaggerated and uneconomical depth.

Figure 2A:
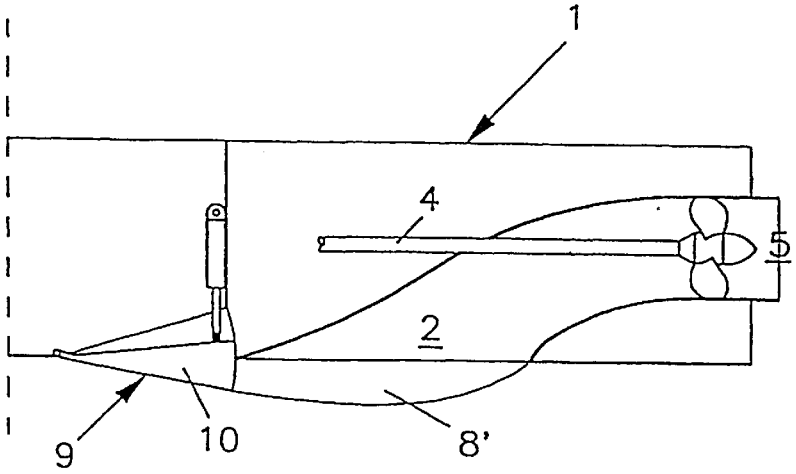
FIGS. 2*a* and 2*b* show corresponding views of a second alternative embodiment of a deflection member of the present invention.
Figure 2B:
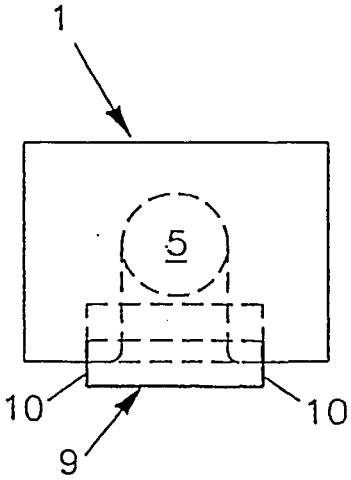

An alternative embodiment of the deflection member is shown in FIGS. 2*a* and 2*b*. The forward edge of the deflection member is a disc shaped flap 9 rotatably attached to the ship hull. The flap 9 is disposed in front of the inlet at the bottom of the ship hull. When the flap is in a non-operational mode, it rests in a recess formed in the bottom of the ship hull. The flap has extendable side portions 10 that, when positioned in an immersed operational mode, prevents water from flowing at the upper edge of the flap. Similar to the first embodiment, the flap may be maneuvered by mechanical, electrical or hydraulic driving or conversion members not described in detail. The driving or conversion members may be of conventional types and should not cause the person of ordinary skill in the art any difficulties in constructing. By immersing the rear edge of the flap 19 in front of the inlet or immediately adjacent the forward edge, of the inlet, the water flow is deflected and a cavity 8' is formed that covers the inlet and drains the channel. No recommendations regarding the required immersion and adjustment angles as measured relative to the base line of the ship hull are given. Instead, the reference letter B in the diagram of FIG. 5 was developed through tests of models. The flap 9 creates a cavity 8' according to the broken line in FIG. 4 that has a slightly different form compared to the cavity 8. The flap 9 is affected by substantial hydrodynamic forces and exerts a higher load on bearing and drive-generating member.

Figure 3A:
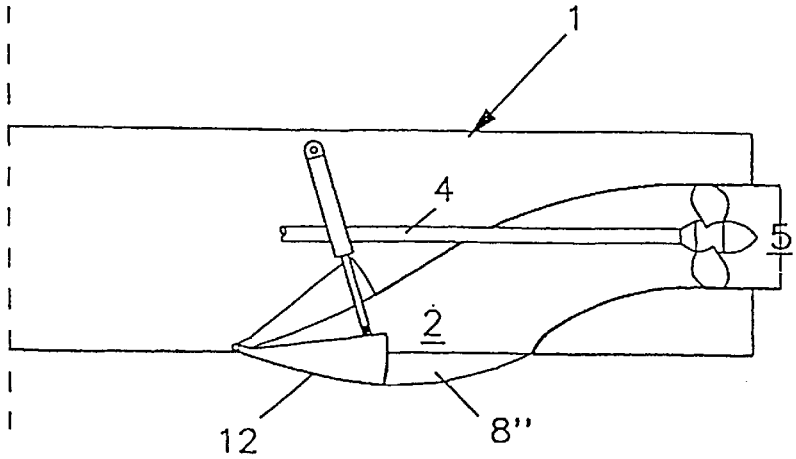
FIGS. 3*a* and 3*b* show corresponding views of a third embodiment of a deflection member of the present invention.
Figure 3B:
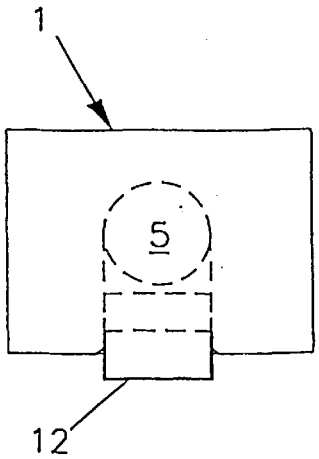

During the development of the present invention a flap 12, as shown in FIGS. 3*a* and 3*b*, was tested. The flap 12 is substantially similar to flap 9. However, the flap 12 is rotatably attached adjacent to the front edge of the inlet. The flap 12 is foldable into a recess defined in the inlet or in the back of the inlet when the flap 12 is in a rest position. In the operative position, the rear edge of the flap 12 extends into the opening of the inlet and thus partially covers the opening. The flap 12 of the model creates in the immersed operational position a cavity 8", as shown in FIG. 4 and as illustrated by the test values C in the diagram of FIG. 5.

It is to be understood that the above mentioned embodiments of the deflection members are adapted to the shape of the bottom of the ship hull so that they do not interfere with the water flow around the ship hull when the deflection members are in the rest position.

While the present invention has been described in accordance with the preferred embodiment, it is to be understood that certain substitutions and alterations may be made thereto without departing from the spirit and scope of the claims. All such modifications which fall within the following claims are claimed.

I claim:

1. A device for a ship hull having multiple water jet driving units having separate inlet channels defined in the ship hull, the device being adapted to drain an inlet channel of a turned off water jet driving mechanism by creating a cavity defined in the relative water flow when the ship is in operational mode, the cavity being disposed outside an inlet opening defined at the inlet to cover the same, comprising:

a shiftable deflection member (6,9,12) attached to a bottom of the ship hull the deflection member (6,9,12) being substantially vertically shiftable relative to the ship hull, the deflection member (6,9,12) being immersible to a depth that depends upon cruising speed of the ship hull, the deflection member (6,9,12) having a shape that is adapted to a shape of the bottom of the ship hull, the deflection member (6,9,12) having a width that is at least as wide as a width of the inlet (2), the deflection member (6,9,12) being movable into an operational position so that an edge of the deflection member, immersed into the water flow, extends perpendicular to a direction of movement of the boat hull adjacent a forward edge of the inlet opening, and preferably disposed immediately in front of the inlet opening.

2. The device according to claim 1 wherein the deflection member includes a disc shaped flap (6) which extends perpendicular to the direction of movement of the ship hull, the flap being adapted for substantially vertical extending and retracting movements to immerse the flap into the relative water flow to a depth that depends upon the cruising speed, the flap is received in a recess (7) defined in the boat hull immediately in front of the inlet (2), the flap has a width that is at least as wide as the width of thee inlet.

3. The deflection member of claim 2 wherein the flap has a width that is up to 180% of the width of the inlet.

4. The device according to claim 1 wherein the deflection member includes a forward edge of a flap (9) which is rotatably attached in front of the inlet, the flap (9) has extendable side edges (10) and drivable for swinging movements for immersion of a rearward edge of the flap into the relative water flow, so that the flap is immersible at an angle which depends upon the cruising speed the flap has a width that is at least as wide as the width of the inlet, and the flap is stored in a recess defined immediately in front of the intake when the flap is in a rest position.

5. The deflection member of claim 4 wherein the flap has a width that is up to 180% of the width of the inlet.

6. The device according to claim 1 wherein the deflection member includes a rotatable flap (12) which is attached immediately in front of a front edge of the inlet, the flap (12) has extendable side edges and drivable for swinging movements for immersing a rearward edge of the flap into the relative water flow, so that the flap is immersible at an angle which depends upon cruising speed and the flap has a width that is at least as wide as the width of the inlet, the flap in rest position being stored in a recess defined in front of the intake, and the flap in operative position partly covering the inlet opening.

7. The deflection member of claim 1 wherein the flap has a width that is up to 180% of the width of the inlet.

8. A method for draining an inlet channel of a turned off water let driving mechanism, the inlet channel being defined in a ship hull in an operational mode and having multiple water jet driving mechanisms with separate inlet channels, comprising the steps of:

immersing a deflection member (6,9,12) into a relative water flow, the deflection member being immersed in front of and adjacent to an inlet (2), the deflection member being immersed to a depth that depends upon cruising speed of the ship hull; and the deflection member (6,9,12) producing a cavity (8,8',8") defined in the water flow that covers the inlet.

9. The method according to claim 8 wherein a disc shaped flap (6) is immersed into the water flow in front of the inlet (2) and protrudes perpendicularly to a direction of movement of the ship hull, the flap is substantially vertically shiftable and immersed to a depth that depends upon the cruising speed.

10. The method according to claim 8 wherein a rotatable disc shaped flap (9) is immersed into the water flow immediately in front of the inlet (2) at an immersion angle that depends upon the cruising speed.

11. The method according to claim 8 wherein a rotatable disc shaped flap (12) is immersed into the water flow in front of the inlet (2) at an immersion angle that depends upon the cruising speed so that the flap partly covers the inlet.

12. The use of a disc shaped flap (6) that is substantially vertically shiftable relative to a bottom of a ship hull, the flap extending perpendicular to a direction of movement of the ship hull, the flap being immersed a depth into the relative water flow during the operation of the ship hull, the depth depending upon cruising speed of the ship hull to create a cavity (8) in the water flow, the cavity covering an inlet to a water jet unit.

* * * * *